US011542696B2

(12) United States Patent
Hobbs

(10) Patent No.: US 11,542,696 B2
(45) Date of Patent: Jan. 3, 2023

(54) FOOT PEDAL FLUSH ACTUATOR FOR TOILET

(71) Applicant: Michele Hobbs, Cincinnati, OH (US)

(72) Inventor: Michele Hobbs, Cincinnati, OH (US)

( * ) Notice: Subject to any disclaimer, the term of this patent is extended or adjusted under 35 U.S.C. 154(b) by 0 days.

(21) Appl. No.: 17/365,582

(22) Filed: Jul. 1, 2021

(65) Prior Publication Data

US 2022/0002987 A1 Jan. 6, 2022

Related U.S. Application Data

(60) Provisional application No. 63/047,568, filed on Jul. 2, 2020.

(51) Int. Cl.
*E03D 5/08* (2006.01)
*E03D 1/26* (2006.01)

(52) U.S. Cl.
CPC ..... *E03D 5/08* (2013.01); *E03D 1/266* (2013.01)

(58) Field of Classification Search
CPC E03D 13/00; E03D 5/024; E03D 5/04; E03D 5/08
See application file for complete search history.

(56) References Cited

U.S. PATENT DOCUMENTS 1,740,860 A * 12/1929 Hansen ..... E03D 5/08 251/293
1,929,522 A * 10/1933 Schulte ..... E03D 5/08 251/231
3,314,084 A * 4/1967 Balikjian ..... E03D 5/024 4/249
3,594,829 A * 7/1971 Seek ..... E03D 13/00 4/310
3,883,904 A 5/1975 Wittman
5,142,708 A 9/1992 Johnson et al.
5,956,779 A * 9/1999 Chung ..... E03D 13/005 4/313
6,718,562 B1 4/2004 Saragas
6,968,579 B1 * 11/2005 Feinberg ..... E03D 5/08 4/246.1
7,003,815 B2 2/2006 Herbst
8,286,273 B1 10/2012 Toomer
9,259,124 B2 2/2016 Wescott, Sr.
10,098,513 B1 10/2018 Robinson
(Continued)

*Primary Examiner* — David P Angwin
*Assistant Examiner* — Nicholas A Ros
(74) *Attorney, Agent, or Firm* — Wood Herron & Evans LLP

(57) ABSTRACT

A flush actuator device with a foot pedal for actuating a flush action at a toilet is provided. The flush actuator device may replace or supplement a manual handle on a conventional toilet and allows flushing action to be initiated by depressing a foot pedal on a floor surface adjacent the toilet. With the flush actuator device, a flush action can be performed using the foot pedal without necessitating any contact with the other parts of the toilet which may be deemed dirty or unsanitary, particularly in public restroom settings. A method of installing the flush actuator device onto an existing toilet is provided. Further, a method for actuating flushing of a toilet using a flush actuator device having a foot pedal is described. The ability to retroactively fit the flush actuator device to an existing toilet eliminates the need for complicated and expensive plumbing fixture replacement.

20 Claims, 8 Drawing Sheets

(56) References Cited

U.S. PATENT DOCUMENTS

| | | | | |
|---|---|---|---|---|
| 10,226,155 | B2 | 3/2019 | Helfrich | |
| 10,358,809 | B2 | 7/2019 | Snyder et al. | |
| 2006/0075545 | A1* | 4/2006 | Herbst | E03D 5/08 4/249 |

* cited by examiner

FOOT PEDAL FLUSH ACTUATOR FOR TOILET

CROSS REFERENCE TO RELATED APPLICATION

This application is a non-provisional application claiming priority to U.S. Provisional Patent Application No. 63/047,568 filed on Jul. 2, 2020, the disclosure of which is hereby incorporated by reference herein in its entirety.

TECHNICAL FIELD

This application relates generally to actuators used in plumbing, and more specifically, to an actuator device configured to flush a toilet.

BACKGROUND

The standard toilet design and construction have remained largely unchanged for decades. In this regard, a toilet typically includes a rear tank or reservoir containing a quantity of water that is released into the bowl of the toilet to "flush" waste products through a siphon and an outlet connected to the bottom of the bowl when a flush valve within the reservoir is opened to permit water flow from the reservoir into the bowl. The flush valve then re-closes so that the reservoir can be refilled with water from a water supply for the next flushing action. The flush valve is typically coupled by a chain or some similar mechanical link to a handle mounted on the exterior of the reservoir. By rotating the handle, the chain is pulled by lever action to lift the flush valve off its seat and initiate the discharge of water into the bowl.

Toilets and specifically these handles are viewed as highly unsanitary by many users, particularly in public restroom settings where many different persons use those facilities. Accordingly, many users choose to actuate the handle using their foot rather than their hand, or even worse, choose to not flush the waste products at all. Such flushing by foot often is a violent action that can damage the handle or toilet and/or can lead to slips and falls that can injure the user.

As such, it would be desirable to provide an improved mechanism for allowing users to more easily actuate flushing of toilets in these types of settings that avoids the potential problems raised by the conventional design. Furthermore, it would be desirable to provide such improved mechanisms in a manner that can be retrofitted to existing toilets so that expensive fixture replacement can be avoided by businesses and other parties that maintain restrooms.

SUMMARY

In accordance with an exemplary embodiment of the invention, a flush actuator device and method of use thereof is described. The flush actuator device of the present invention addresses the problems and reduces the drawbacks of current apparatuses and methods for actuator devices configured to flush a toilet, as developed in the background section above.

In one implementation, a flush actuator device for actuating a flush action at a toilet is disclosed. The flush actuator device includes a control box attached to a reservoir of the toilet. The control box is configured to interact with and move a lever arm within the reservoir of the toilet. The lever arm connects to a flush valve. The flush actuator device further includes a foot pedal. The foot pedal is configured to interact with the control box. Depressing the foot pedal causes the control box to interact with the lever arm in such a way as to actuate the flush action at the toilet. The flush actuator device also includes a control line attached at an end to the control box and attached at an opposing end to the foot pedal. The control line is configured to hydraulically transfer an input from the foot pedal to the control box to thereby cause the control box to move the lever arm and actuate opening of the flush valve.

In one embodiment of the flush actuator, the control box is located inside of the reservoir. Further, the control box may replace a handle for operating the flush valve of the toilet. The handle is removed from the toilet.

In another embodiment of the flush actuator, the control box includes a drive block configured to receive and transfer the input from the control line through a plurality of passages within the drive block. The control block further includes a drive piston extending from the drive block and configured to move between an extended position and a retracted position. The drive piston is in fluid communication with the plurality of passages within the drive block. The control box also includes a top pulley located a distance away from the drive block and drive piston, such that the top pulley is connected to an end of the drive piston by a drive wire extending from the end of the drive piston and along a periphery of the top pulley. Furthermore, the input from the foot pedal is transferred through the plurality of passages within the drive block to the drive piston such that the input causes the drive piston to change from the extended position to the retracted position thereby pulling the drive wire and rotating the attached top pulley.

In a further embodiment of the flush actuator, the plurality of passages within drive block include a first passage in fluid communication with an end of the control line. The first passage is configured to receive the input from the control line. The plurality of passages also includes a second passage in fluid communication with the drive piston. The second passage is configured to transfer the input to the drive piston. Further, the plurality of passages also includes a joining passage extending laterally between the first passage and the second passage. The joining passage joins the first passage and the second passage in fluid communication.

In yet another embodiment of the flush actuator, the drive piston includes a spring at an opposite end of the drive piston that biases the drive piston towards the extended position. The input overcomes the spring bias to change the drive piston from the extended position to the retracted position.

In one embodiment of the flush actuator, the top pulley includes a center axle that extends through an aperture in the reservoir and connects to the lever arm. Rotating the top pulley rotates the center axle, applies a torque to the lever arm, and thereby actuates the flush action at the toilet. The top pulley may also include a collar that extends around and is secured to the center axle. The collar houses a spring that biases the collar, center axle, and top pulley towards an initial position. In the initial position, the flush valve of the toilet is not open. The flush actuator device may further include a bushing inserted between the collar and the reservoir to reduce frictional wear caused by rotation of the collar with the top pulley and center axle. Further, the top pulley may include an inner collar on the center axle within the reservoir. The inner collar is configured to provide a mounting location for the lever arm of the toilet.

In another embodiment of the flush actuator, the foot pedal includes a piston block attached on a side to a base plate. The piston block includes bearing elements on an outer surface thereof. The piston block also includes a chamber therein. The chamber is in fluid communication with the control line. The control line is attached to the piston block and is configured to transfer the input from the piston block. The foot pedal further includes a pedal pivotally attached to the bearing elements of the piston block. The pedal includes a support shaft carried by the bearing elements such that the support shaft can freely rotate within the bearing elements. Further, the pedal is configured to interact with the piston block and provide the input to the piston block. Moreover, the piston block includes a front piston plate connected to the piston block by a piston head and the pedal includes an actuator arm extending from the support shaft into operative engagement with the front piston plate. Depressing the pedal rotates the support shaft and moves the actuator arm to push the front piston plate into the piston block thereby compressing the chamber and transferring the input from the foot pedal through the control line and to the control box. Additionally, the piston block may include a pedal spring to bias the piston head, front piston plate, actuator arm, and pedal towards an unpressed position. Furthermore, the pedal may feature a U-shaped construction of bar-like elements where each of a first and a second end of the U-shaped construction connect to the support shaft.

In a further embodiment of the flush actuator, the piston block includes a refill port on the outer surface thereof. The refill port is in fluid communication with the chamber and is configured to permit a refilling of the chamber. Also, the piston block may further include a set screw on the outer surface thereof. The set screw is in fluid communication with the chamber and is configured to permit a release from the chamber during the refilling.

In another implementation, a method of actuating flushing of a toilet is disclosed. The method includes providing a flush actuator device. The flush actuator device includes a control box attached to a reservoir of the toilet, a foot pedal configured to interact with the control box, and a control line attached at one end to the control box and attached at an opposing end to the foot pedal. The method further includes depressing the foot pedal. The foot pedal is configured to interact with the control box in such a way as to actuate the flush action at the toilet. The method also includes transferring the input from the foot pedal to the control box by the control line. The control line is configured to transfer the input hydraulically. Additionally, the method includes moving a lever arm within the reservoir by the control box. The lever arm connects to a flush valve. Furthermore, the method includes lifting the flush valve to permit water to flow from the reservoir.

In yet another implementation, a method of retrofitting a toilet to allow for foot pedal-driven flushing is disclosed. The method includes providing a flush actuator device. The flush actuator device includes a control box configured to be attached to a reservoir of the toilet, a foot pedal configured to interact with the control box, and a control line configured to be attached at one end to the control box and attached at an opposing end to the foot pedal. The method further includes installing the control box onto the reservoir. The control box includes a drive block configured to receive and transfer an input from the control line, a drive piston extending from the drive block and configured to move between an extended position and a retracted position, and a top pulley located a distance away from the drive block and drive piston, such that the top pulley is connected to an end of the drive piston by a drive wire extending from the end of the drive piston and along a periphery of the top pulley. The method also includes connecting the top pulley to a lever arm within the reservoir of the toilet. The lever arm is connected to a flush valve. The top pulley is connected to an end of a center axle and the lever arm is connected to an opposing end of the center axle. The center axle extends through an aperture in the reservoir. Furthermore, the method includes connecting the control line at the end to the drive block of the control box and at the opposing end to a piston block of the foot pedal. Additionally, the method includes securing the foot pedal to a surface proximate to the toilet.

In one embodiment, the method further includes removing a handle for operating the flush valve from the toilet prior to installing the control box. Further, the step of installing the control box onto the reservoir may further or alternatively include attaching the control box to a wall on an interior of the reservoir, and snaking the control line from the interior of the reservoir between a lid of the reservoir and the wall of the reservoir to an exterior of the reservoir.

In another embodiment, the method also includes refilling the piston block of the foot pedal with a hydraulic fluid through the refill port. The refill port is in fluid communication with a chamber of the piston block and the refill port is configured to permit the refilling of the chamber. The method may further include tightening the set screw. The set screw is configured to permit a release from the chamber during the refilling.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

With reference to FIGS. 1-6, embodiments of a flush actuator device 10 are shown. The flush actuator device 10 advantageously allows flushing action to be initiated by depressing a foot pedal 12 mounted to a floor surface adjacent the toilet 14. Consequently, a user of the toilet 14 does not need to dirty their hands by contacting a handle 16 or some other flushing mechanism, as a flush action can be performed using the foot pedal 12 without necessitating any contact with the other parts of the toilet 14 which may be deemed dirty or unsanitary, particularly in public restroom settings. Damage and injury risks associated with the practice of kicking the handle 16 on a conventional toilet 14 can also be avoided using the design described herein. The flush actuator device 10 thereby improves the operation of toilets by making them more convenient and sanitary to use in all settings, public or private. Furthermore, the flush actuator device 10 can be provided as a kit that can be installed in place of or in addition to the handle on a pre-existing conventional toilet, thereby enabling the technical advantages of this design to be achieved without necessitating complicated and expensive plumbing fixture replacement.

Figure 1:
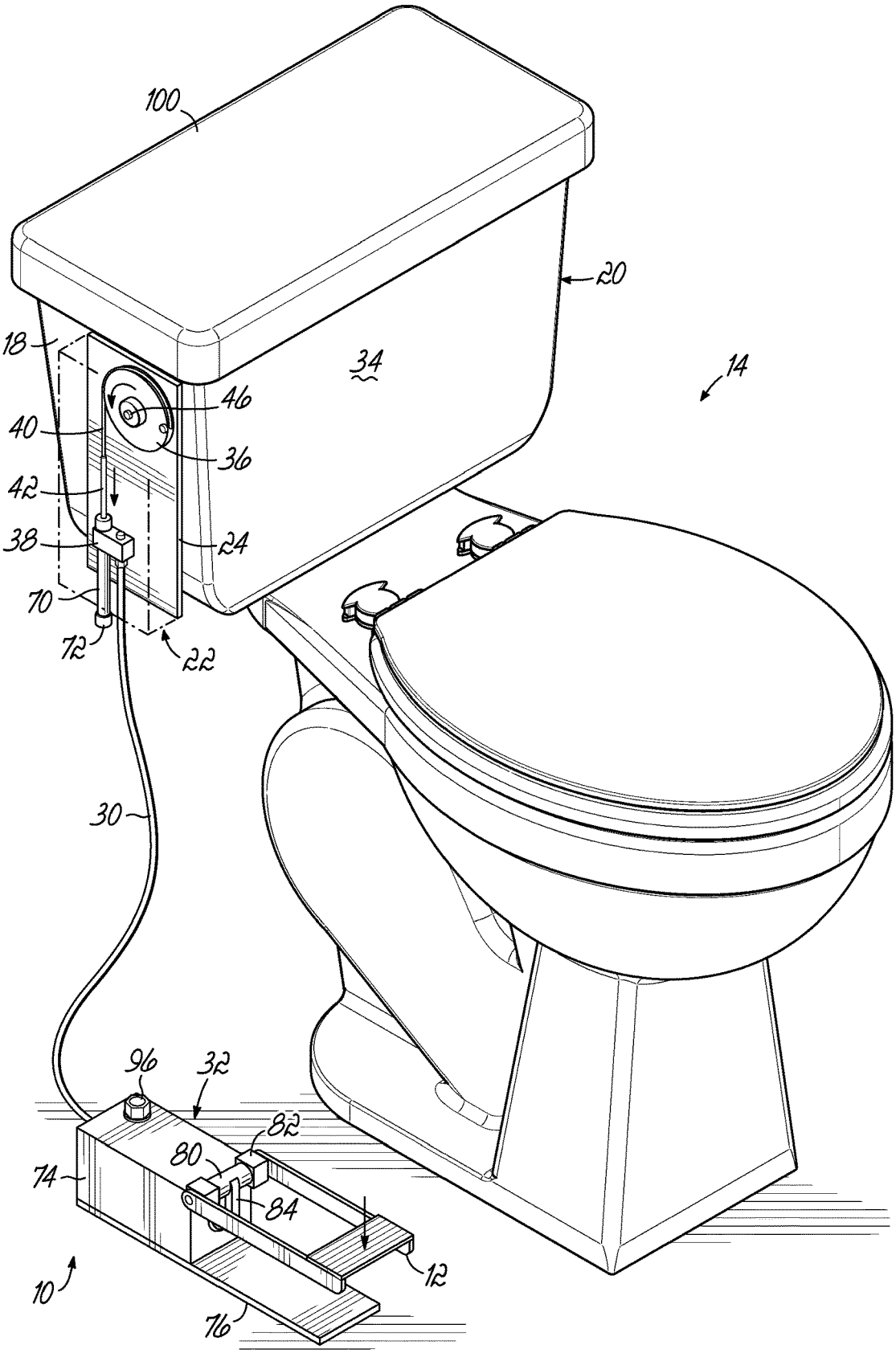
FIG. 1 is a perspective view of a flush actuator device installed at a toilet, in accordance with one embodiment.
Figure 4:
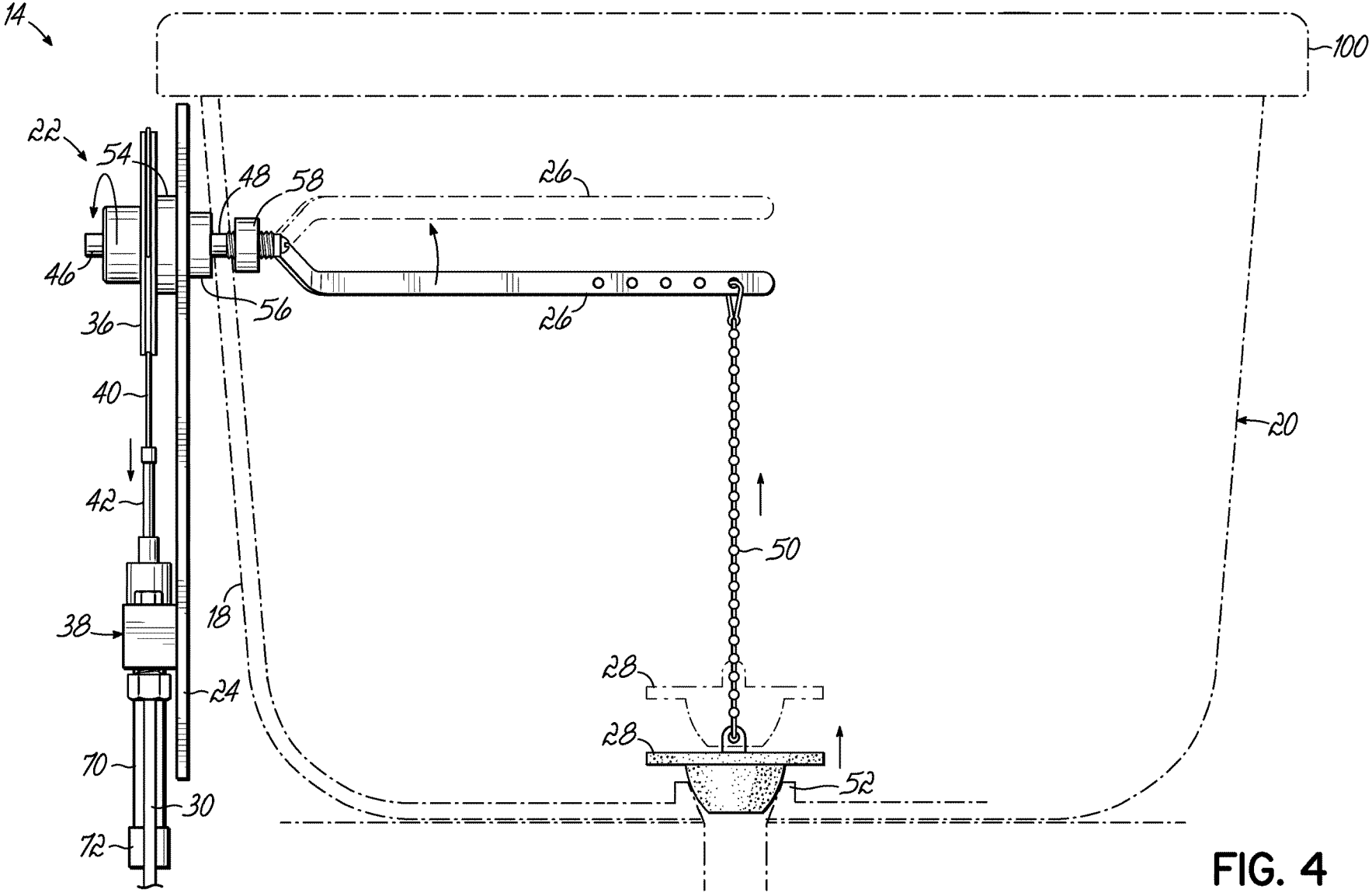
FIG. 4 is a front, detailed view of the reservoir of the toilet of FIG. 1, showing the flush actuator mounted on an exterior of the reservoir.
Figure 5:
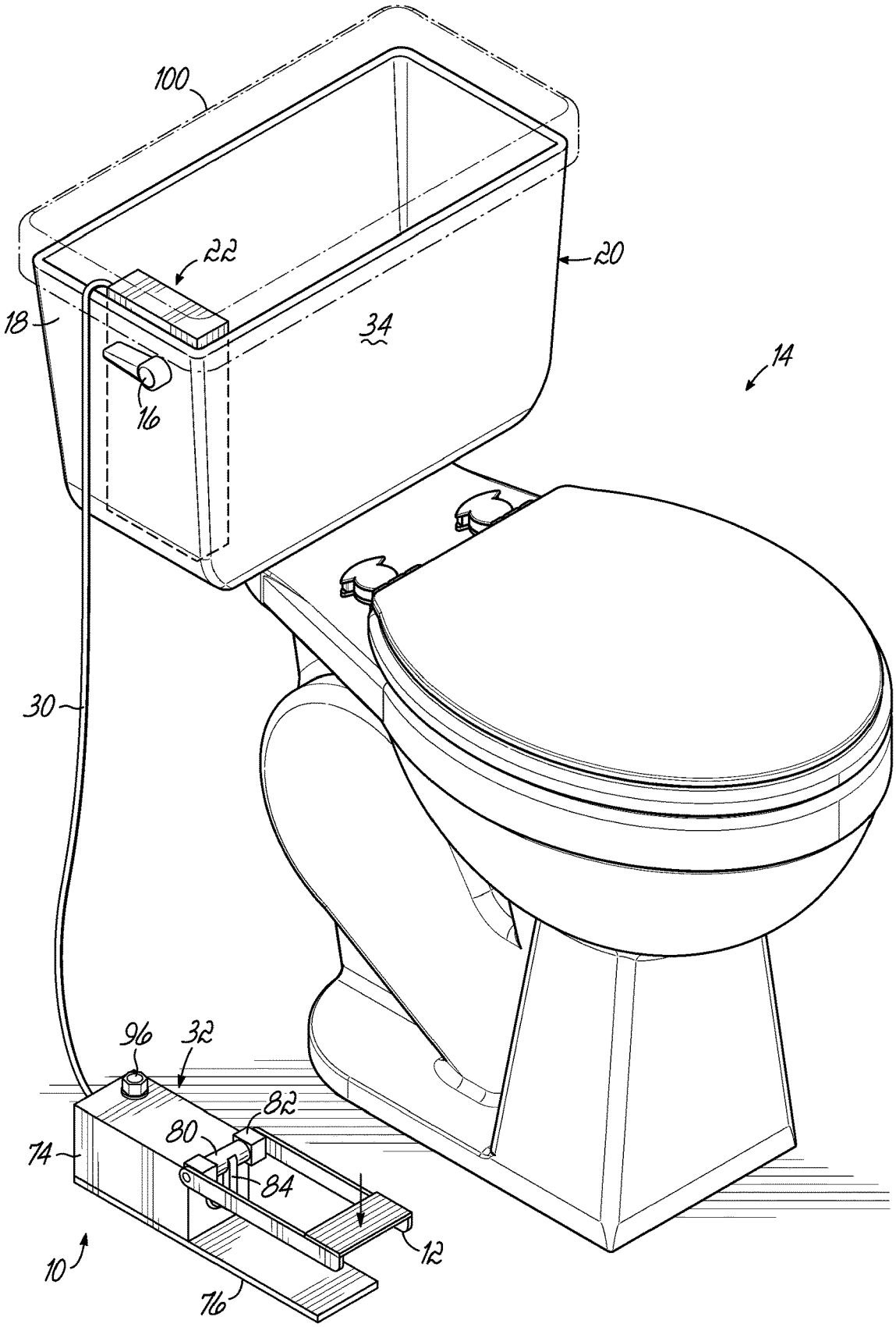
FIG. 5 is a perspective view of a flush actuator device installed within the reservoir of a toilet, in accordance with an alternative embodiment.
Figure 6:
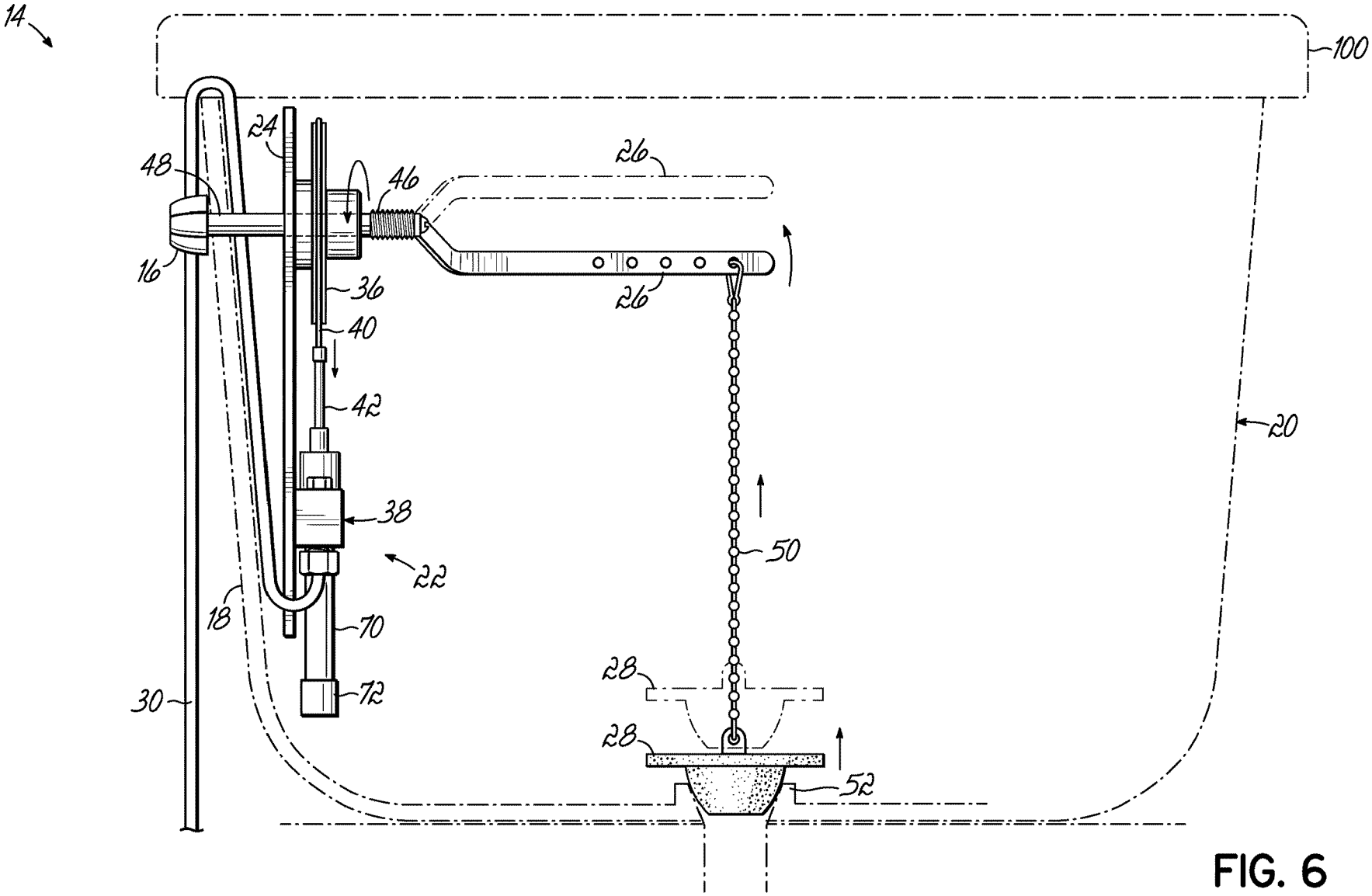
FIG. 6 is a front, detailed view of the reservoir of the toilet of FIG. 5, showing the flush actuator device mounted on an interior of the reservoir.

With reference to FIG. 1, the components of one embodiment of the flush actuator device 10 are shown as installed on a toilet 14. The handle 16 conventionally provided on this toilet 14 would normally be mounted on the side wall 18 of the reservoir 20. This handle 16 is replaced by the control box 22 shown mounted on an enlarged metal plate 24 along this same side wall 18 of the reservoir 20. The control box 22 components are described in further detail below with respect to FIGS. 2A and 2B, but are generally configured to apply a torque force to the lever arm 26 within the reservoir 20 that connects to the flush valve 28 and normally connects to the handle 16 for such input torque force, thereby to open the flush valve 28 and selectively cause a flush action at the toilet 14, as shown best in FIG. 4. The components of the control box 22 are connected by a control line 30, portions of which are visible in FIG. 1, for example, to a foot pedal assembly 32 located on a side of the toilet 14 along a floor surface. The foot pedal assembly 32 components are described in further detail below with respect to FIGS. 3A and 3B. In short, the pedal-depressing action at the foot pedal assembly 32 is transferred by a series of mechanical and/or pneumatic/hydraulic control devices such that this action becomes the torque force applied to open the flush valve 28, as is typically done manually to flush the toilet 14. An alternative embodiment of the flush actuator device 10 is shown in FIGS. 5 and 6. In the alternative embodiment, the control box 22 is attached to the interior of the reservoir 20 instead of to the exterior of the reservoir 20, as is the case for the embodiment depicted in FIGS. 1-4. In each embodiment, the control box 22 may include an enclosed box (shown in phantom lines in the Figures) to prevent interference with the operating components and/or watertight sealing of such components when placed inside the reservoir 20 that also contains flush water.

Figure 2A:
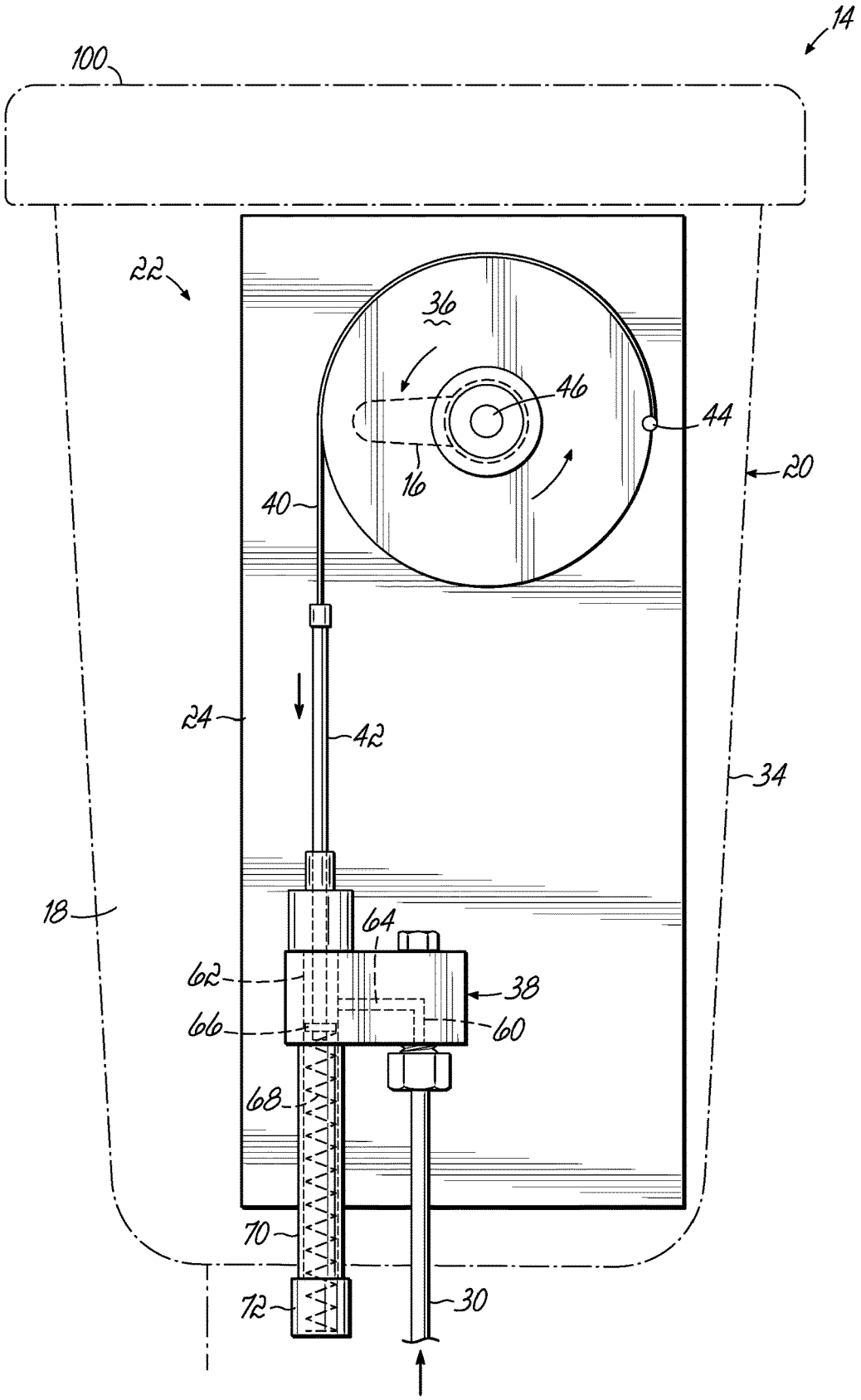
FIG. 2A is a detailed view of control box components mounted along a side of the reservoir of the toilet of FIG. 1.
Figure 2B:
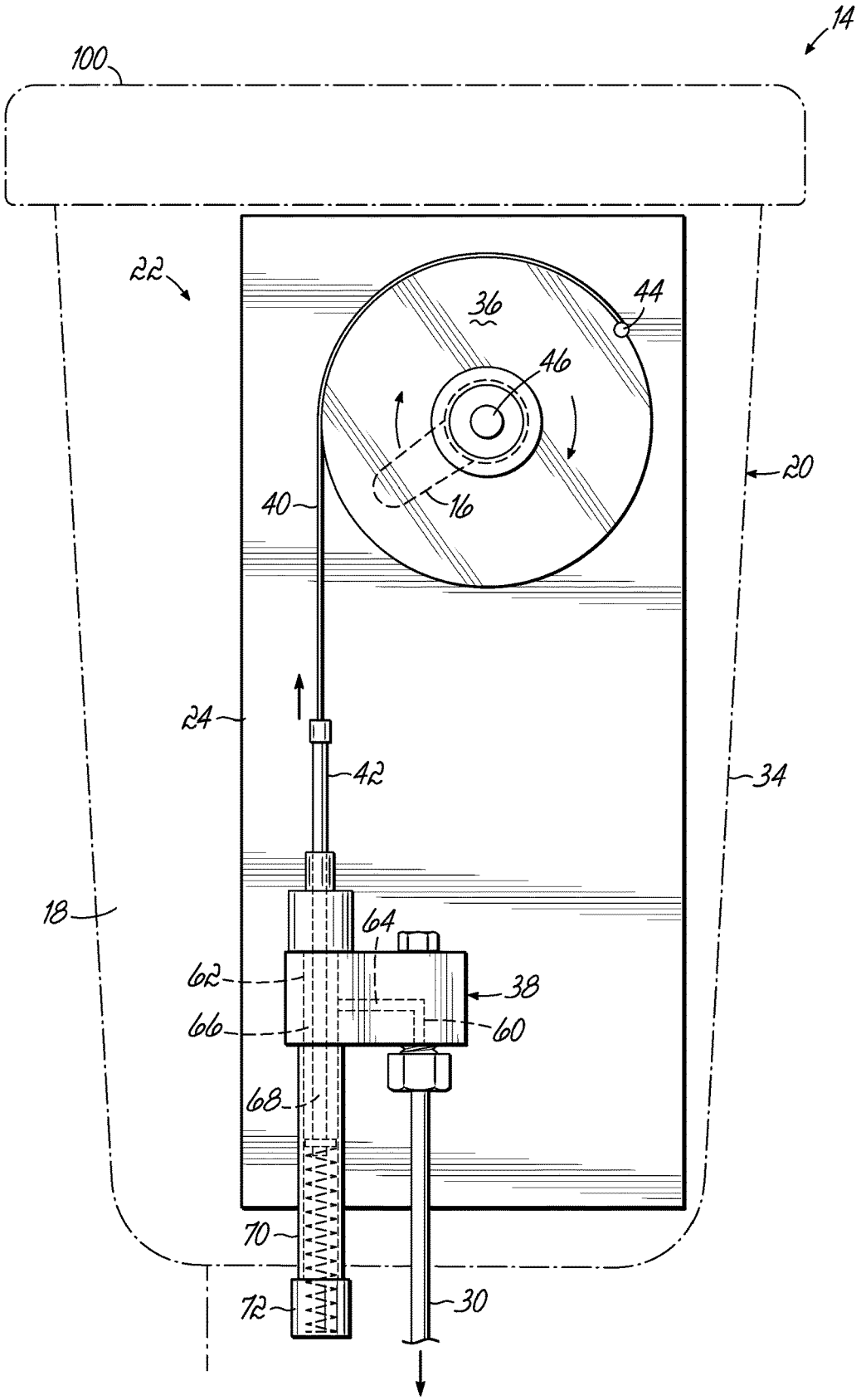
FIG. 2B is a further detailed view of the control box components mounted along a side of the reservoir of the toilet of FIG. 1, with the control box components moved to a different position than in FIG. 2A.

The control box 22 components are shown in further detail with reference to FIGS. 2A and 2B. The control box 22 components in this illustrated embodiment are all mounted along a generally planar metal plate 24. It will be understood that such a plate 24 could be outwardly extended to become an outer control box that encloses each of the components shown in these Figures (as shown in FIG. 1 or 5, for example). Furthermore, while the elements defining the control box 22 components could be resized and reorganized in position in other embodiments, the illustrated embodiment shows that the control box 22 components take up a minimal amount of width/space along a side wall 18 of the reservoir 20. As such, the control box 22 components can generally fit for installation along this portion of any conventional toilet 14 having a side-mounted handle 16. It will be understood that alternative embodiments may locate a portion of the control box 22 components along a front wall 34 of the reservoir 20 when a handle 16 being replaced is in that location on the toilet 14. However, such alternative control boxes 22 would remain configured to fit along the side of the reservoir 20 and/or in the location normally filled by the handle 16 such that this flush actuator device 10 can be installed without impacting the normal use of the toilet 14 (including lid opening and closing, and users sitting on the toilet).

The control box 22 components in this embodiment include a top pulley 36 and a drive block 38 located generally underneath the top pulley 36. A drive wire 40 extends from one end connected to a drive piston 42 located within the left side of the drive block 38 upwardly and around a portion of the periphery defined by the top pulley 36, with an opposite end of the drive wire 40 secured to the top pulley 36 at a position adjacent its outer periphery. In the illustrated embodiment, the opposite end of the drive wire 40 is secured in position on the top pulley 36 using a fastener 44 extending through the depth of the top pulley 36. The top pulley 36 is mounted on a center axle 46 allowing for rotational movement of the top pulley 36 relative to the remainder of the control box 22 and relative to the toilet 14. As best illustrated in FIG. 4, the center axle 46 extends through an aperture 48 in the reservoir 20 of the toilet 14 in the same manner as a conventional handle 16, with an internal end of the center axle 46 connected to the lever arm 26 and/or chain 50 extending to the flush valve 28 of the toilet 14. As shown by the arrows in FIG. 4, rotations of the top pulley 36 cause the chain 50 to pull the flush valve 28 off of its seat 52 to initiate a flush action, as well understood in the toilet art.

With continued reference to FIGS. 2A and 2B, in one particular example, the top pulley 36 is connected to a collar element 54 (shown in FIG. 4, for example) that extends around and is secured to the center axle 46. A nylon bushing 56 is inserted between the collar element 54 and the side wall 18 of the reservoir 20 of the toilet 14 to avoid frictional wear caused by the rotation of the collar element 54 with the top pulley 36 and the center axle 46. The collar element 54 also houses a torsion spring that biases the collar element 54, and therefore also the center axle 46 and the top pulley 36, towards an initial position where a flush action is not being initiated, e.g., in a position where the lever arm 26 and/or chain 50 is not pulling the flush valve 28 off its seat 52 within the reservoir 20. An inner collar 58 may also be provided on the center axle 46 inside the reservoir 20 to provide a mounting location for connecting to the lever arm 26 and/or chain 50 connected to the flush valve 28 of the toilet 14.

The drive block 38 is now described in further detail. As shown at FIGS. 2A and 2B, the drive block 38 includes internal passages 60, 62, 64 containing elements configured to transfer a drive input delivered through the control line 30 connected to the right side of the drive block 38 into linear movement of the drive piston 42 extending out of the left side of the drive block 38. One example of the internal elements and internal passages 60, 62, 64 defined in the drive block 38 are shown in FIGS. 2A and 2B. To this end, the illustrated embodiment is hydraulically actuated and as such, the internal passages 62, 60 on the left and right sides of the drive block 38 are connected by a joining passage 64 extending laterally between the internal passages 62, 60 on the left and right. The internal passage on the right side 60 of the drive block 38 is in communication with one end of the control line 30, which in this embodiment communicates water or some other similar hydraulic fluid into and out of the internal passages 60, 62, 64 in the drive block 38. The internal passage on the left side 62 of the drive block 38 carries the drive piston 42 that can be driven downwardly by hydraulic fluid being pushed into the drive block 38 from the control line 30. Such downward movement of the drive piston 42 forces a pulling, downward movement of the aforementioned drive wire 40, which then rotates the top pulley 36 to cause the flush action as described above. The stem of the drive piston 42 extends out of a top end of the drive block 38 through appropriate sealing O-ring(s) as will be understood in the hydraulics art. The head/ram 66 of the drive piston 42 that is forced to move by the hydraulic pulse is also engaged with a return spring 68 contained within the cylinder 70 through which the drive piston 42 moves, the cylinder 70 being shown capped off below the drive block 38 on the left side. For example, the return spring 68 may be a compression spring captured between a bottom side of the head/ram 66 and the end cap 72 on the cylinder 70, such that the return spring 68 biases the drive piston 42 upwardly to help assure the drive piston 42 and the top pulley 36 return to the original position following a flush action.

With continued reference to FIGS. 2A and 2B, the Figures illustrate a series of positions showing movement of elements at the control box 22 during actuation of a flush action. In FIG. 2A, the top pulley 36 and the drive piston 42 at the drive block 38 are in an original position, this original position corresponding to the state within the reservoir 20 where the flush valve 28 is fully engaged with its seat 52. The arrows in FIG. 2A indicate how the components will move from their original positions. In FIG. 2B, the aforementioned hydraulic pulse from the foot pedal assembly 32 and the control line 30 have acted on the head 66 of the drive piston 42, thereby forcing the drive piston 42 and the drive wire 40 to move downwardly, which also causes the top pulley 36 to rotate counterclockwise, as shown in this view. This movement, which is also against the bias applied by the torsion spring at the top pulley 36 and by the return spring 68 at the drive block 38, continues as shown until the drive piston 42 is pulled to a fully actuated position. The top pulley 36 and the center axle 46 have been rotated through an arc of approximately 45 degrees of rotation, which is sufficient to cause the lever arm 26 and/or chain 50 within the reservoir 20 to pull the flush valve 28 off its seat 52 and allow for a flush action to occur at the toilet 14. The motion shown in this sequence of FIGS. 2A and 2B is then reversed by action of the bias applied by the torsion spring and the return spring 68 to push the drive piston 42 and drive wire 40 back upwardly to rotate the top pulley 36 clockwise again back to the original position to prepare for the next flush action request, as shown by the arrows in FIG. 2B.

Figure 3A:
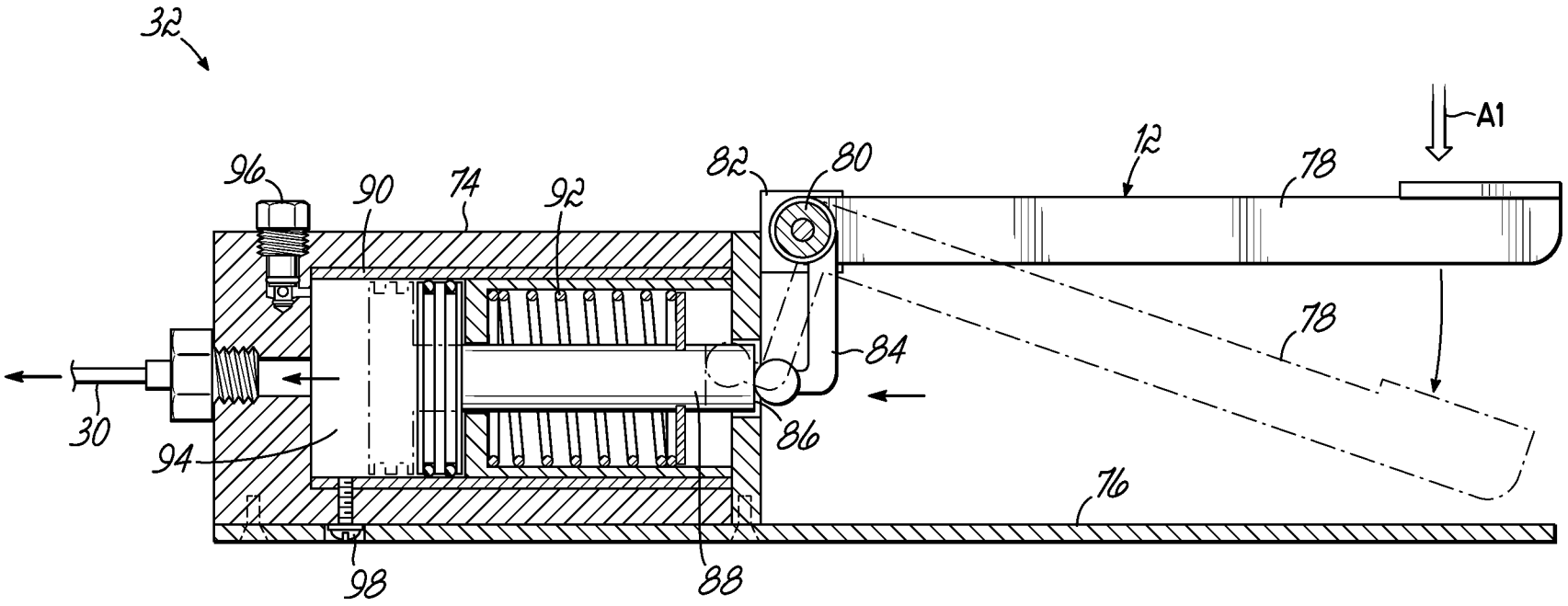
FIG. 3A is a cross-sectional view of the foot pedal assembly of the flush actuator device of FIG. 1.
Figure 3B:
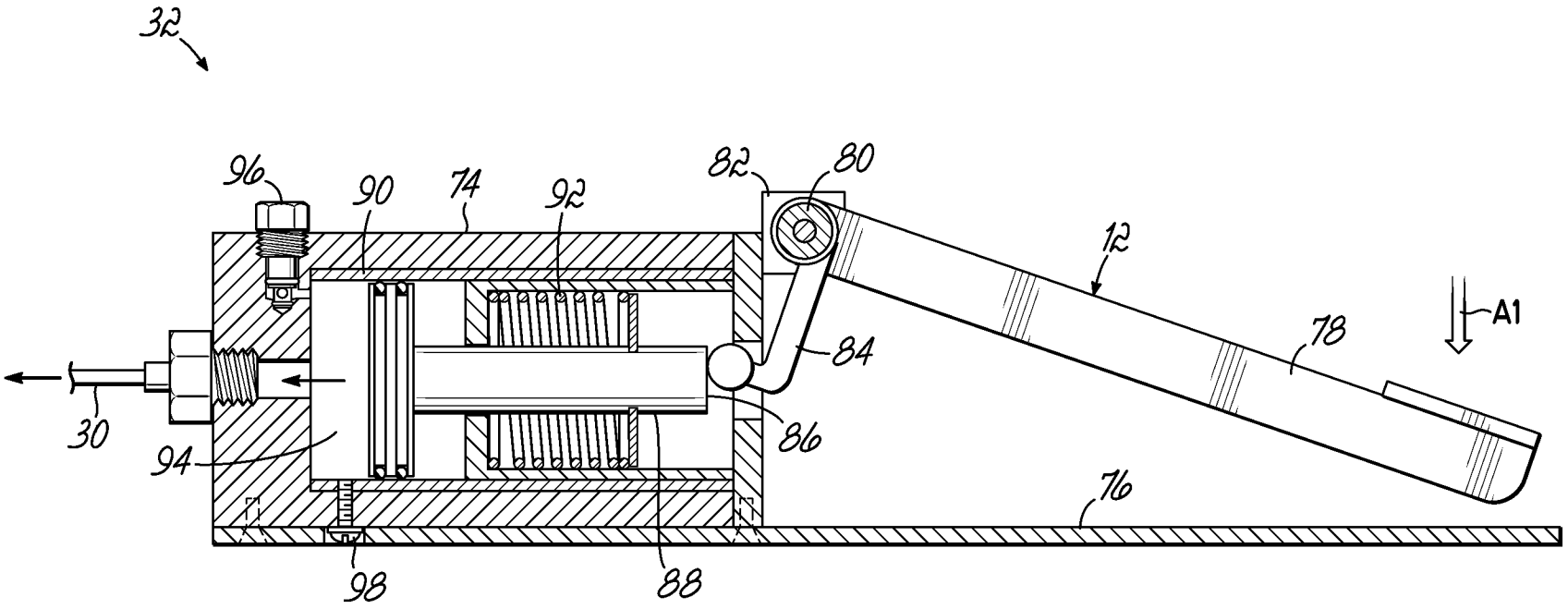
FIG. 3B is a further cross-sectional view of the foot pedal assembly of the flush actuator device of FIG. 1, with the foot pedal moved to a different position than in FIG. 3A.

FIGS. 3A and 3B illustrate details of the foot pedal assembly 32 in more detail in this embodiment. The foot pedal assembly 32 includes a piston block 74 along a rear side thereof and a foot pedal 12 along the front side thereof. Both the piston block 74 and the foot pedal 12 may be supported on a base plate 76 of the foot pedal assembly 32 which can be secured by fasteners or the like to a floor surface at a desired position adjacent the base of the toilet 14. The foot pedal 12 is of a U-shaped construction of bar-like elements 78 that is connected on both ends of the U-shaped construction to a support shaft 80 carried within bearing elements 82 connected to a top front corner of the piston block 74. The support shaft 80 is free to rotate within the bearing elements 82 and such rotation can be driven by depression of the foot pedal 12, as shown by arrow A1. In the middle of the support shaft 80, an actuator arm 84 is connected to and extends into operative engagement with a front piston plate 86. Rotation of the support shaft 80 caused by depression of the foot pedal 12 moves the actuator arm 84 to press the front piston plate 86 rearwardly to move into the piston block 74.

The piston block 74 of the foot pedal assembly 32 contains internal structure such as a piston head 88 connected to the front piston plate 86 for movement within a cylinder 90. A pedal spring 92 may also be located in the piston block 74 to bias the piston head 88, and therefore also the front piston plate 86, actuator arm 84, and foot pedal assembly 32 back to an original position with the foot pedal 12 not being depressed. To this end, the pedal spring 92 and the aforementioned torsion spring (of the collar 54) and return spring 68 (of the drive piston 42) work in conjunction to always return the elements of the flush actuator device 10 back to the original position between flush cycles. The piston head 88 of this embodiment moves to compress a chamber 94 filled with water or other hydraulic fluid, this chamber 94 connected in fluid communication at the rear of the piston block 74 with one end of the control line 30.

Further, the piston block 74 may include a refill port 96. The refill port 96 may be located on a top side of the piston block 74. It is to be understood that alternative locations for the refill port 96 are possible. The refill port 96 allows a user to refill the chamber 94 in the event that there is a hydraulic discharge or if the piston block 74 requires repair. For example, a user could refill the chamber 94 with hydraulic fluid using a glue syringe or similar through the refill port 96 without having to disassemble the piston block 74. To that end, the piston block 74 may further include a set screw 98. The set screw 98 may be located on the bottom of the piston block 74 or in another suitable location. When loosened, the set screw 98 allows liquids or gases to escape the chamber 94, for example, when the chamber 94 is being refilled with a hydraulic fluid. Once the chamber 94 has been refilled with hydraulic fluid, a user a can retighten the set screw 98 thereby resealing the hydraulic chamber 94.

With continued reference to FIGS. 3A and 3B, when the foot pedal 12 is pushed downwardly by a user (as shown by arrow A1), the front piston plate 86 and the piston head 88 are forced to move towards the hydraulic fluid, thereby forcing a pulse of hydraulic fluid through the control line 30 and into the drive block 38 at the control box 22, which results in the flush action movements described in detail above. Consequently, a user depressing the foot pedal 12 causes the toilet 14 to flush in a similar fashion as rotating the handle 16 on a conventional toilet 14. Such foot pedal 12 actuation on the floor surface avoids the need for a user to lift their foot and leg up to kick a handle 16 on the reservoir 20 of the toilet 14, while also avoiding the need for contact between the user's hand and a handle 16 or other elements on the toilet 14, leading to the technical advantages described above.

FIG. 4 further illustrates how this embodiment of the flush actuator device 10, mounted on the exterior of the reservoir 20, interacts with the toilet 14 components within the reservoir 20. Specifically, FIG. 4 shows the center axle 46 connecting the flush actuator device 10 on the outside of the reservoir 20 to the toilet 14 components within the reservoir 20. The center axle 46 extends through the aperture 48 in the reservoir 20 of the toilet 14 in the same manner that a conventional handle 16 would. An external end of the center axle 46 is connected to the top pulley 36 of the flush actuator device 10. An internal end of the center axle 46 is connected to the lever arm 26 and/or chain 50 extending to the flush valve 28 of the toilet 14. The control box 22 components, described above, are configured to apply a torque force to the lever arm 26 within the reservoir 20 upon receiving an input (e.g., hydraulic pulse) from the foot pedal assembly 32. As shown by the arrows in FIG. 4, applying the force to the lever arm 26 causes the chain 50 to pull the flush valve 28 off of its seat 52 and initiates a flush action.

It will be understood that while the motion is hydraulically driven through the control line 30 in the illustrated embodiment, the transfer of motion from the foot pedal assembly 32 through to the control box 22 may be done in other known manners in alternative embodiments. For example, instead of hydraulic fluid drive, the pistons 42, 88 may be pneumatically driven by pressurized air within the control line 30 in a similar embodiment. The use of hydraulics and/or pneumatics is advantageous as their use minimizes the number of parts that could wear over time, especially in an environment like a public bathroom where frequent exposure to harsh chemicals and hot water (e.g., for cleaning) is likely. Alternatively, a fully mechanical drive may be provided by extending a threaded metal cable or the like through the control line 30 to extend between the piston block 74 at the foot pedal assembly 32 and the drive block 38 on the control box 22. One end of this metal cable may be connected to the piston head 88 at the piston block 74 of the foot pedal assembly 32, while the other end of this metal cable could be attached to a lever or linkage within the internal passages 60, 62, 64 of the drive block 38. Movement of the metal cable into the drive block 38 could thus be mechanically translated by the lever or linkage into downward movement of the drive piston 42 and drive wire 40 in such embodiments, thereby accomplishing the same end result of initiating a flush action whenever the foot pedal 12 is depressed by a user. It will also be appreciated that the other mechanical elements described herein may be re-positioned and re-configured in other embodiments so long as the core functionality remains the same, e.g., depression of a foot pedal 12 results in some movement translated to opening the flush valve 28 within a toilet 14.

Turning to FIGS. 5 and 6, these Figures illustrate an alternative embodiment of the flush actuator device 10. In the depicted alternative embodiment, the control box 22 is located inside of the toilet reservoir 20 as opposed to on the exterior of the reservoir 20, as shown in the embodiment depicted in FIGS. 1-4. FIG. 5 shows the control box 22 located inside of the reservoir 20. Further, the Figure shows the control line 30 extending from the control box 22 located in the interior of the reservoir 20, between a side wall 18 and lid 100 of the reservoir 20, and to the exterior of the reservoir 20 where the control line 30 can connect to the foot pedal assembly 32. It is to be understood that the control box 22 may be placed in a location within the reservoir 20 other than the location expressly depicted in the Figure (e.g., on the side wall). For example, the control box 22 could be located on a front wall 34 of the reservoir 20 as opposed to a side wall 18. Regardless of the location of the control box 22, in this embodiment the toilet handle 16 may remain on the exterior of the reservoir 20 and be used as an alternative to actuate a flush action of the toilet 14.

FIG. 6 illustrates how the alternative embodiment makes use of the aperture 48 in the reservoir 20 of the toilet 14 typically used for the toilet handle 16, similar to the embodiment shown in FIGS. 1-4. However, in this embodiment the control box 22 does not occupy the space typically used for the handle 16. Thus, in this embodiment the manual toilet handle 16 and the flush actuator device 10 could co-exist and either could be used to actuate a flush action of the toilet 14. Further, FIG. 6 better shows how the control line 30 snakes from the interior of the reservoir 20, between the side wall 18 and lid 100 of the reservoir 20, and to the exterior of the reservoir 20.

As originally noted above, all these components described for the flush actuator device 10 may be provided as a kit that may be installed to retrofit an existing toilet 14 with the capability of foot-actuated flushing. To this end, the kit may include the foot pedal assembly 32, the control line 30, and the control box 22 in some level of pre-assembly. The control box 22 can be mounted at the corresponding aperture 48 for the existing handle 16 (inside or outside of the reservoir 20), and the lever arm 26 and/or chain 50 within the reservoir 20 is connected in position on the center axle 46 extending into the reservoir 20 once the control box 22 is in position. The control line 30 can then be connected, if it is not already, to the control box 22 and to the piston block 74 of the foot pedal assembly 32, and the foot pedal assembly 32 can be fastened in position on the floor surface if desired. The kit therefore quickly and easily replaces and/or supplements the existing handle 16 structure of the toilet 14 and converts the toilet 14 to a foot-actuated flush without necessitating specialty hardware or plumbing fixture replacement. Thus, the design goals of removing the need for toilet 14 users to manually actuate a handle 16 to flush the toilet 14 are achieved even for existing toilets 14. Of course, the flush actuator device 10 can be pre-installed as a component of new toilets 14 to be installed as well.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A flush actuator device for actuating a flush action at a toilet, the flush actuator device comprising:

a control box attached to a reservoir of the toilet, the control box configured to interact with and move a lever arm within the reservoir of the toilet, the lever arm connecting to a flush valve;

a foot pedal configured to interact with the control box, wherein depressing the foot pedal causes the control box to interact with the lever arm in such a way as to actuate the flush action at the toilet; and a control line attached at an end to the control box and attached at an opposing end to the foot pedal, the control line configured to hydraulically transfer an input from the foot pedal to the control box to thereby cause the control box to move the lever arm and actuate opening of the flush valve, wherein the control box comprises:

a drive block configured to receive and transfer the input from the control line through a plurality of passages within the drive block;

a drive piston extending from the drive block and configured to move between an extended position and a retracted position, the drive piston in fluid communication with the plurality of passages within the drive block; and a top pulley located a distance away from the drive block and drive piston, such that the top pulley is connected to an end of the drive piston by a drive wire extending from the end of the drive piston and along a periphery of the top pulley, wherein the input from the foot pedal is transferred through the plurality of passages within the drive block to the drive piston such that the input causes the drive piston to change from the extended position to the retracted position thereby pulling the drive wire and rotating the attached top pulley.

2. The flush actuator device of claim 1, wherein the control box is located inside of the reservoir.

3. The flush actuator device of claim 1, wherein the control box replaces a handle for operating the flush valve of the toilet, the handle being removed from the toilet.

4. The flush actuator device of claim 1, the plurality of passages within drive block comprising:

a first passage in fluid communication with an end of the control line, the first passage configured to receive the input from the control line;

a second passage in fluid communication with the drive piston, the second passage configured to transfer the input to the drive piston; and a joining passage extending laterally between the first passage and the second passage, the joining passage joining the first passage and the second passage in fluid communication.

5. The flush actuator device of claim 1, the drive piston including a spring at an opposite end of the drive piston that biases the drive piston towards the extended position, wherein the input overcomes a spring bias to change the drive piston from the extended position to the retracted position.

6. The flush actuator device of claim 1, the foot pedal comprising:

a piston block attached on a side to a base plate, the piston block including bearing elements on an outer surface thereof, the piston block further including a chamber therein, the chamber in fluid communication with the control line, the control line attached to the piston block and configured to transfer the input from the piston block; and a pedal pivotally attached to the bearing elements of the piston block, the pedal including a support shaft carried by the bearing elements such that the support shaft can freely rotate within the bearing elements, wherein the pedal is configured to interact with the piston block and provide the input to the piston block.

7. The flush actuator device of claim 1, the top pulley including a center axle that extends through an aperture in the reservoir and connects to the lever arm, wherein rotating the top pulley rotates the center axle, applies a torque to the lever arm, and thereby actuates the flush action at the toilet.

8. The flush actuator device of claim 7, the top pulley including an inner collar on the center axle within the reservoir, the inner collar configured to provide a mounting location for the lever arm of the toilet.

9. The flush actuator device of claim 7, the top pulley including a collar that extends around and is secured to the center axle, the collar housing a spring that biases the collar, center axle, and top pulley towards an initial position, wherein in the initial position the flush valve of the toilet is not open.

10. The flush actuator device of claim 9, wherein a bushing is inserted between the collar and the reservoir to reduce frictional wear caused by rotation of the collar with the top pulley and center axle.

11. A flush actuator device for actuating a flush action at a toilet, the flush actuator device comprising:

a control box attached to a reservoir of the toilet, the control box configured to interact with and move a lever arm within the reservoir of the toilet, the lever arm connecting to a flush valve:

a foot pedal configured to interact with the control box, wherein depressing the foot pedal causes the control box to interact with the lever arm in such a way as to actuate the flush action at the toilet; and a control line attached at an end to the control box and attached at an opposing end to the foot pedal, the control line configured to hydraulically transfer an input from the foot pedal to the control box to thereby cause the control box to move the lever arm and actuate opening of the flush valve, wherein the foot pedal comprises:

a piston block attached on a side to a base plate, the piston block including bearing elements on an outer surface thereof, the piston block further including a chamber therein, the chamber in fluid communication with the control line, the control line attached to the piston block and configured to transfer the input from the piston block; and a pedal pivotally attached to the bearing elements of the piston block, the pedal including a support shaft carried by the bearing elements such that the support shaft can freely rotate within the bearing elements, wherein the pedal is configured to interact with the piston block and provide the input to the piston block.

12. The flush actuator device of claim 11, the pedal featuring a U-shaped construction of bar-like elements, wherein each of a first and a second end of the U-shaped construction connect to the support shaft.

13. The flush actuator device of claim 11, the piston block including a refill port on the outer surface thereof, the refill port in fluid communication with the chamber and configured to permit a refilling of the chamber, the piston block further including a set screw on the outer surface thereof, the set screw in fluid communication with the chamber and configured to permit a release from the chamber during the refilling.

14. The flush actuator device of claim 11, the piston block including a front piston plate connected to the piston block by a piston head and the pedal including an actuator arm extending from the support shaft into operative engagement with the front piston plate, wherein depressing the pedal rotates the support shaft and moves the actuator arm to push the front piston plate into the piston block thereby compressing a fluid within the chamber and transferring the input from the foot pedal through the control line and to the control box.

15. The flush actuator device of claim 14, the piston block including a pedal spring to bias the piston head, front piston plate, actuator arm, and pedal towards an unpressed position.

16. A method of retrofitting a toilet to allow for foot pedal-driven flushing, the method comprising:

providing a flush actuator device, the flush actuator device comprising:

a control box configured to be attached to a reservoir of the toilet;

a foot pedal configured to interact with the control box; and a control line configured to be attached at one end to the control box and attached at an opposing end to the foot pedal;

installing the control box onto the reservoir, the control box comprising:

a drive block configured to receive and transfer an input from the control line;

a drive piston extending from the drive block and configured to move between an extended position and a retracted position; and a top pulley located a distance away from the drive block and drive piston, such that the top pulley is connected to an end of the drive piston by a drive wire extending from the end of the drive piston and along a periphery of the top pulley;

connecting the top pulley to a lever arm within the reservoir of the toilet, the lever arm connected to a flush valve, the top pulley connected to an end of a center axle and the lever arm connected to an opposing end of the center axle, the center axle extending through an aperture in the reservoir;

connecting the control line at the end to the drive block of the control box and at the opposing end to a piston block of the foot pedal; and securing the foot pedal to a surface proximate to the toilet.

17. The method of claim 16, further comprising:

removing a handle for operating the flush valve from the toilet prior to installing the control box.

18. The method of claim 16, the step of installing the control box onto the reservoir further comprising:

attaching the control box to a wall on an interior of the reservoir; and snaking the control line from the interior of the reservoir between a lid of the reservoir and the wall of the reservoir to an exterior of the reservoir.

19. The method of claim 16, further comprising:

refilling the piston block of the foot pedal with a hydraulic fluid through a refill port, the refill port in fluid communication with a chamber of the piston block and configured to permit the refilling of the chamber; and tightening the set screw, the set screw configured to permit a release from the chamber during the refilling.

20. The method of claim 16, wherein the foot pedal comprises:

the piston block, which is attached on a side to a base plate, the piston block including bearing elements on an outer surface thereof, the piston block further including a chamber therein, the chamber in fluid communication with the control line, the control line attached to the piston block and configured to transfer the input from the piston block; and a pedal pivotally attached to the bearing elements of the piston block, the pedal including a support shaft carried by the bearing elements such that the support shaft can freely rotate within the bearing elements, wherein the pedal is configured to interact with the piston block and provide the input to the piston block.

* * * * *